US005268149A

United States Patent [19]

Arafat

[11] Patent Number: 5,268,149

[45] Date of Patent: Dec. 7, 1993

[54] UNIVERSAL TRANSPORTATION TRAY FOR LABORATORY VOLUMETRIC EQUIPMENT

[76] Inventor: Nabil Arafat, 571 Dundas St. East, Waterdown, Ontario, Canada, L0R 2H0

[21] Appl. No.: 28,211

[22] Filed: Mar. 9, 1993

[30] Foreign Application Priority Data

Mar. 9, 1992 [GB] United Kingdom ..... 9205082

[51] Int. Cl.[5] ..... B01L 3/00; B01L 9/06; A47F 3/14

[52] U.S. Cl. ..... 422/102; 206/560; 206/565; 211/126; 211/162; 220/630; 422/104

[58] Field of Search ..... 206/560, 565; 220/625, 220/629, 630, 638; 211/94, 126, 162, 128; 422/99, 102, 104

[56] References Cited

U.S. PATENT DOCUMENTS

| | | | |
|---|---|---|---|
| 2,346,430 | 4/1944 | Hauser | 211/126 X |
| 3,650,588 | 3/1972 | Helland | 211/126 X |
| 3,655,063 | 4/1972 | Landry | 211/126 X |
| 3,797,842 | 3/1974 | Swick, Jr. et al. | 211/126 X |
| 4,113,329 | 9/1978 | Thurman | 211/126 X |
| 4,502,741 | 3/1985 | De Vries et al. | 211/126 X |
| 4,560,072 | 12/1985 | Burell | 211/126 X |
| 4,600,107 | 7/1986 | Price et al. | 211/126 X |
| 4,730,735 | 3/1988 | Lechner | 211/126 X |
| 5,016,948 | 5/1991 | Welch et al. | 211/126 X |
| 5,103,986 | 4/1992 | Marlowe | 211/126 X |

*Primary Examiner*—James C. Housel
*Assistant Examiner*—Mihon I. Cano

[57] ABSTRACT

A carrying tray comprising a pair of end walls and a pair of side walls defining a rectangular space, a pair of half-shelves adapted to be received within the rectangular space for carrying objects thereon, and apparatus or rigidly securing the objects relative to the rectangular space. The half-shelves may be positioned at various heights to accommodate different sizes of object to be carried, such as flasks and containers.

7 Claims, 1 Drawing Sheet

UNIVERSAL TRANSPORTATION TRAY FOR LABORATORY VOLUMETRIC EQUIPMENT

FIELD OF THE IVNENTION

This invention relates in general to carrying intent, and more particularly to a universal transportation tray for carrying flasks.

BACKGROUND OF THE IVNENTION

Chemists and technologists are occasionally required to transport volumetric and erlenmeyer flasks which are filled with samples from one area to another area, or from one floor to another floor within a building. Most often, where a plurality of such flasks are required to be transported, the chemists and technologists utilize well known prior art rolling laboratory carts. One disadvantage of using laboratory carts for the transportation of flasks is that the samples can be subjected to severe shaking which can cause spillage as a result of such laboratory carts passing over rough floors, etc. This problem is particularly acute when the chemist or technologist attempts to roll the laboratory cart off of an elevator which is not precisely level with the building floor.

SUMMARY OF THE IVNENTION

According to the present invention, a transportation tray is provided in which the flasks to be transported may be secured against accidental shaking and spillage. According to an aspect of the invention, the tray may easily adjusted to accommodate flasks of various sizes. By securing the flasks during transportation, the prior art problems of sample spillage and excessive shaking are overcome.

BRIEF DESCRIPTION OF THE DRAWINGS

A detailed description of the invention is provided herein below with reference to the following drawings, in which.

DETAILED DESCRIPTION OF THE PREFERRED EMBODIMENT

Figure 1:
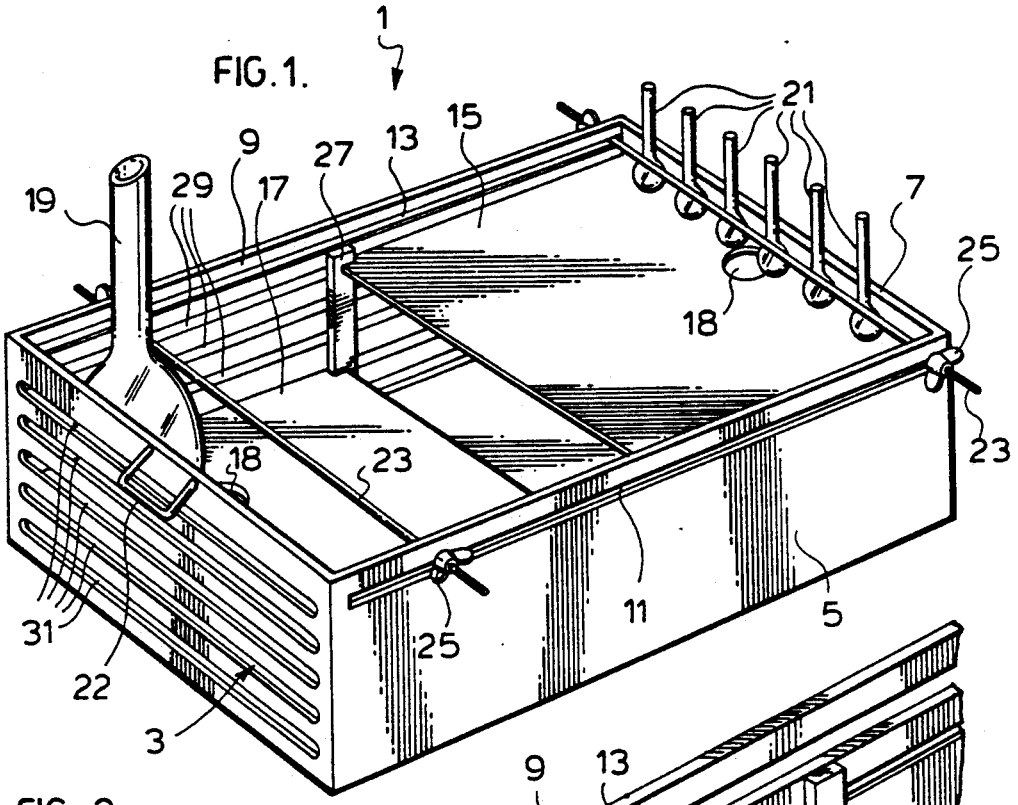
FIG. 1 is a perspective view of a flask transportation tray according to the preferred embodiment of the present invention.

Turning to FIG. 1, the general design of the tray 1 is shown comprising four walls 3, 5, 7 and 9 defining a generally rectangular space. A pair of slots 11 and 13 extend through side wall 5 and 9, respectively. The tray 1 is shown with two bottom levels defined by half-shelves 15 and 17 for accommodating different sizes of flasks 19 and 21. Holes 18 are provided to facilitate insertion and removal of the trays 15 and 17. The tray can be mounted on a frame with wheels (not shown) in a well known manner, and a pair of handles 22 are provided on front and rear end walls 3 and 7 for moving the tray 1. Preferably, the handles 22 are angled downwardly at approximately 45° from horizontal.

In order to secure the flasks 19 and 21 in place, a plurality of stainless steel bars 23 covered with rubber tubing, are inserted through the oppositely disposed slots 11 and 13 and locked into position via wing nuts 25 on each end. The ends of the sliding bars 23 are threaded to receive the locking wing nuts 25 (or other suitable locking mechanism). When the bar 23 is locked in place as shown in FIG. 1, the flasks 19 and 21 are prevented from lateral movement such that tipping of the flasks becomes impossible under ordinary circumstances.

A projection in the form of a molded bar 27 is provided as a stop abutment for the inside edges of the shelves 15 and 17. Furthermore, slots 31 are provided in the sidewalls 3 and 7 through which the shelves 15, 17, etc., may be inserted and removed.

Figure 2:
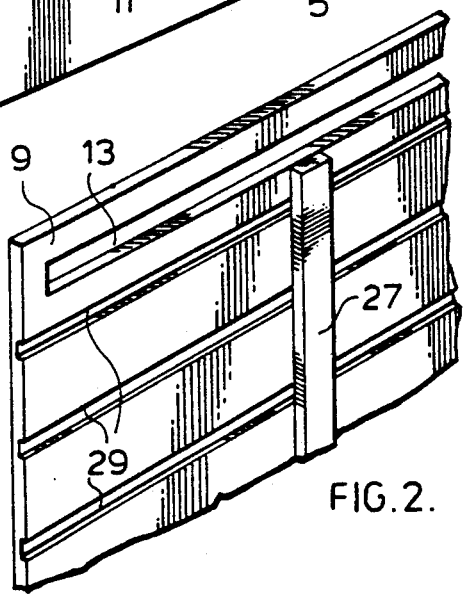
FIG. 2 is a perspective view showing a side panel of the tray according to the preferred embodiment.

In FIG. 2, the side wall 9 is shown in detail with molded bar 27 and lateral grooves 29 for receiving the edges of the shelves 15 and 17. In the perspective view of FIG. 1, only one bar 27 can be seen. However, it will be understood that a corresponding bar is located opposite bar 27 on side wall 5.

Figure 3:
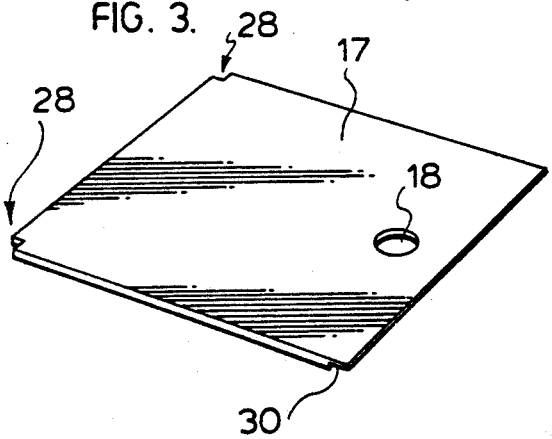
FIG. 3 is a perspective view of a removable tray according to the preferred embodiment.
Figure 4:
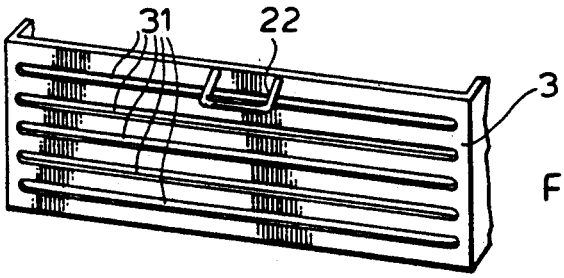
FIG. 4 is an elevation view of an end wall according to the preferred embodiment.

In FIG. 3, a shelf 17 is shown in greater detail comprising rectangular notches 28 at the ends thereof. The notches 28 lie flush with bar 27 when the shelf is fully inserted into the tray. The front edge of each of the shelves 15 and 17 is preferably routed along the entire width thereof so as to provide a step-like undercut or locking channel 30 on the bottom surface. The slots 31 in end walls 3 and 7 are preferably located slightly above the grooves 29 in side wall 5 and 9 such that upon inserting the shelves 15 and 17 fully within the grooves or slots 29, the undercut or locking channel 30 of each of the shelves drops into locking engagement with the ridge formed between the displaced grooves 29 and slots 31, thereby locking the shelves 15 and 17 in place.

According to the preferred embodiment, the tray 1 is fabricated of plastic, although wood, polyvinyl, metal or other suitable material may be used.

In a successful prototype of the invention, the inside dimensions of the tray 1 were as follows: width=12", length=20", height - 5⅛", slots 11 and 13 where each ¼" high and approximately 9½" long, and the grooves 29 were preferably spaced 1" vertically apart.

In use, the trays 15 and 17 are inserted into the tray 1 to the appropriate height for carrying flasks such as 19 and 21, by selecting the appropriate one of the slots 31 in end walls 3 and 7, the slots 31 being located adjacent to (but slightly above predetermined corresponding ones of the grooves 29. When the trays 15 and 17 are inserted into the slots 31, the sides of the shelves 15 and 17 follow the grooves 29 in side walls 5 and 9. Once the shelves 15 and 17 are fully inserted into the tray so that the rectangular notches 28 contact the bar 27, the undercut or locking channel 30 of each of the shelves drops into locking engagement with the ridge formed between the displaced grooves 29 and the slots 31.

The flasks 19, 21, etc., are then placed on the shelves 15 and 17. In order to hold the flasks in position for transportation, the stainless steel bars 23 (covered with rubber tubing) are inserted through the oppositely disposed slots 11 and 13 and are locked into position via the wing nuts 25 at each end.

In order to remove either of the shelves 15 or 17, the shelf is lifted via grabbing the shelf through hole 18 so that the undercut or locking channel 30 rises over the ridge formed between the displaced groove 29 and slot 31, and the shelf is then simply pulled out through slot 31.

Other embodiments or variations of the invention are possible. For example, as an alternative to using wing nuts 25, copper nuts, or other suitable attachment means can be used. All such embodiments or variations are believed to be within the sphere and scope of the invention as defined by the claims appended hereto.

I claim:

1. A carrying tray comprising:

a pair of end walls and a pair of side walls defining a rectangular space, a pair of adjustable shelves received within said rectangular space for carrying objects thereon, means for rigidly securing said objects relative to said rectangular space, said means for rigidly securing comprises a pair of oppositely disposed slots in said pair of side walls, at least one rod sliding within said pair of slots so as to be positioned against respective ones of said objects, means for locking said at least one rod, and a plurality of parallel grooves arranged at different heights therein on said side walls for securing and supporting side edges of said pair of shelves at selectable ones of said different heights within said rectangular space.

2. The carrying trays of claim 1, wherein said at least one rod include threaded portions at opposite ends thereof, said at least one rod being of sufficient length that said threaded portions project outwardly through said pair of slots, and wherein said means for locking comprises a pair of wing nuts adapted to be received by said threaded portions and tightened against said pair of side walls.

3. The carrying trays of claim 1, further including a projection from each of said pair of sidewalls for limiting movement of said pair of shelves within said grooves to approximately mid-way along said rectangular space.

4. The carrying tray of claim 1, wherein each of said end walls further includes a plurality of parallel slots arranged adjacent to respective one of said grooves for inserting and removing said pair of shelves into and out of said respective grooves.

5. The carrying tray of claim 4, wherein said plurality of parallel slots are disposed above respective ones of said grooves so as to form respective ridges therebetween, and wherein each of said pair of shelves is routed along the width thereof so as to provide a step-like undercut adapted to lockingly engage said ridges when said pair of shelves are inserted into said grooves.

6. The carrying tray of claim 1, further including a pair of handles mounted to said end walls.

7. The carrying tray of claim 1, wherein each of said pair of shelves includes a hole therein for facilitating insertion and removal of respective ones of said pair of shelves into and out of said rectangular space.

* * * * *